United States Patent [19]

Hosaka

[11] Patent Number: 4,594,669

[45] Date of Patent: Jun. 10, 1986

[54] ICE CONTROL METHOD INCLUDING CONTROL SCHEDULE UPDATE

[75] Inventor: Akio Hosaka, Yokohama, Japan

[73] Assignee: Nissan Motor Co., Ltd., Yokohama, Japan

[21] Appl. No.: 565,600

[22] Filed: Dec. 27, 1983

[30] Foreign Application Priority Data

Dec. 29, 1982 [JP] Japan ..... 57-229921

[51] Int. Cl.[4] ..... F02D 37/02

[52] U.S. Cl. ..... 364/431.05; 74/857; 123/480

[58] Field of Search ..... 364/424.1, 431.05; 74/856, 857, 866; 123/436, 419, 480

[56] References Cited

U.S. PATENT DOCUMENTS

| | | | |
|---|---|---|---|
| 2,842,108 | 7/1958 | Sanders | 123/436 |
| 4,201,161 | 5/1980 | Sasayama et al. | 364/431.05 |
| 4,235,204 | 11/1980 | Rice . | |
| 4,291,594 | 9/1981 | Baudoin | 74/866 |
| 4,322,800 | 3/1982 | Hisegawa et al. | 364/431.05 |
| 4,381,684 | 5/1983 | Himmelstein | 74/857 |
| 4,403,584 | 9/1983 | Suzuki et al. | 364/431.05 |
| 4,423,485 | 12/1983 | Sami et al. | 364/431.05 |
| 4,466,521 | 8/1984 | Hattori et al. | 74/866 |

FOREIGN PATENT DOCUMENTS

| | | |
|---|---|---|
| 0038083 | 10/1981 | European Pat. Off. . |
| 0061735 | 10/1982 | European Pat. Off. . |
| 57-185501 | 10/1982 | Japan . |
| 57-161346 | 11/1982 | Japan . |
| 1605061 | 12/1981 | United Kingdom . |

*Primary Examiner*—Parshotam S. Lall

*Attorney, Agent, or Firm*—Schwartz, Jeffery, Schwaab, Mack, Blumenthal & Evans

[57] ABSTRACT

Operational parameters such as engine rotational speed, torque output and fuel consumption are continuously monitored and an engine control schedule updated using filtered data so as to calibrate same against the current or actual state of the engine and therefore compensate not only for the effect of wear which occurs with the passing of time, but also the unit to unit difference which is inherently present in production engines.

22 Claims, 5 Drawing Figures

ICE CONTROL METHOD INCLUDING CONTROL SCHEDULE UPDATE

BACKGROUND OF THE INVENTION

1. Field of the Invention

The present invention relates generally to an internal combustion engine control method and more specifically to a control method wherein a control schedule or schedules are updated so as to accurately reflect the current state and individual characteristics of the engine.

2. Description of the Prior Art

FIG. 1 shows an engine system disclosed in Japanese Patent Application Provision Publication No. Sho 57-185501 published on Nov. 15, 1982. In brief, this arrangement includes a central control unit 1 including a microprocessor (comprising a CPU, RAM, ROM, an input interface and an output interface), a battery 2, a starter motor 3, an ignition key switch 4, an induction manifold 5, a throttle valve 6, an air flow meter 7, a throttle switch 8 which outputs a signal indicative of the throttle valve 7 being closed (i.e. idling position), an induction manifold pressure regulator arrangement which includes electromagnetic valves 10, 11, an EGR valve 12, (the vacuum chamber of which is controlled by the aforementioned electromagnetic valve 11), a by-pass control valve 13 which controls the amount of air by-passed around the throttle valve via passage 14 (and thus the idling speed of the engine), a fuel pump 15, a fuel pressure regulator valve 16, a fuel pump control relay 17, a fuel injection valve (or valves) 18, a coolant temperature sensor 19, an exhaust manifold 20, an oxygen sensor 21, a crank angle sensor 22 which produces both a unit angle signal and a reference signal, an ignition coil 23, a spark plug (or plugs) 24, a transmission 25 (of the stepped plural forward speed type), a transmission neutral position indicating switch 26, an air conditioner switch 27 (for indicating the air conditioner being in use), a vehicle speed sensor 28, an alarm lamp 29 for indicating abnormal conditions and a fuel flow meter or the like 30 which indicates the amount of fuel being consumed by the engine per unit time.

The central control unit 1 receives a plurality of inputs and uses one or more control schedules stored in the ROM of the microprocessor to control the fuel injection, air-fuel ratio of the mixture fed to the combustion chambers, the EGR rate, idling speed etc., in a manner to minimize the fuel consumption of the engine while maintaining adequate power output and desired levels of exhaust control.

However, as the schedules via which the engine is controlled are fixed, a drawback is encountered in that the dimensional variations which occur from unit to unit during production of a number of engines (e.g. mass production) and the wear which occurs with the passing of time and which varies with the manner in which the engine is treated, the desired optimal performance is in fact not achieved due to the inability of fixed schedules to take into account the aforementioned unpredictable variations.

SUMMARY OF THE INVENTION

It is accordingly an object of the present invention to provide an engine control method which updates the control schedule or schedules utilized therein in a manner to tailor same to the current state and the particular characteristics of the engine controlled thereby.

In brief, the present invention features a method wherein operational parameters such as engine rotational speed, torque output and fuel consumption are continuously monitored and an engine control schedule updated using filtered data so as to calibrate same against the current or actual state of the engine and therefore compensate not only for the effect of wear which occurs with the passing of time, but also the unit to unit difference which is inherently present in production engines.

More specifically, the present invention takes the form of a method of controlling an apparatus wherein operational parameters thereof change with use, which includes the steps of: continuously sensing at least two of the parameters, periodically updating a control schedule in response to the values of the parameters sensed, and controlling the apparatus in accordance with the control schedule so as to optimize the efficiency of same.

BRIEF DESCRIPTION OF THE DRAWINGS

The features and advantages of the arrangement of the present invention will become more clearly appreciated from the following description taken in conjunction with the accompanying drawings in which.

DESCRIPTION OF THE PREFERRED EMBODIMENTS

Figure 1:
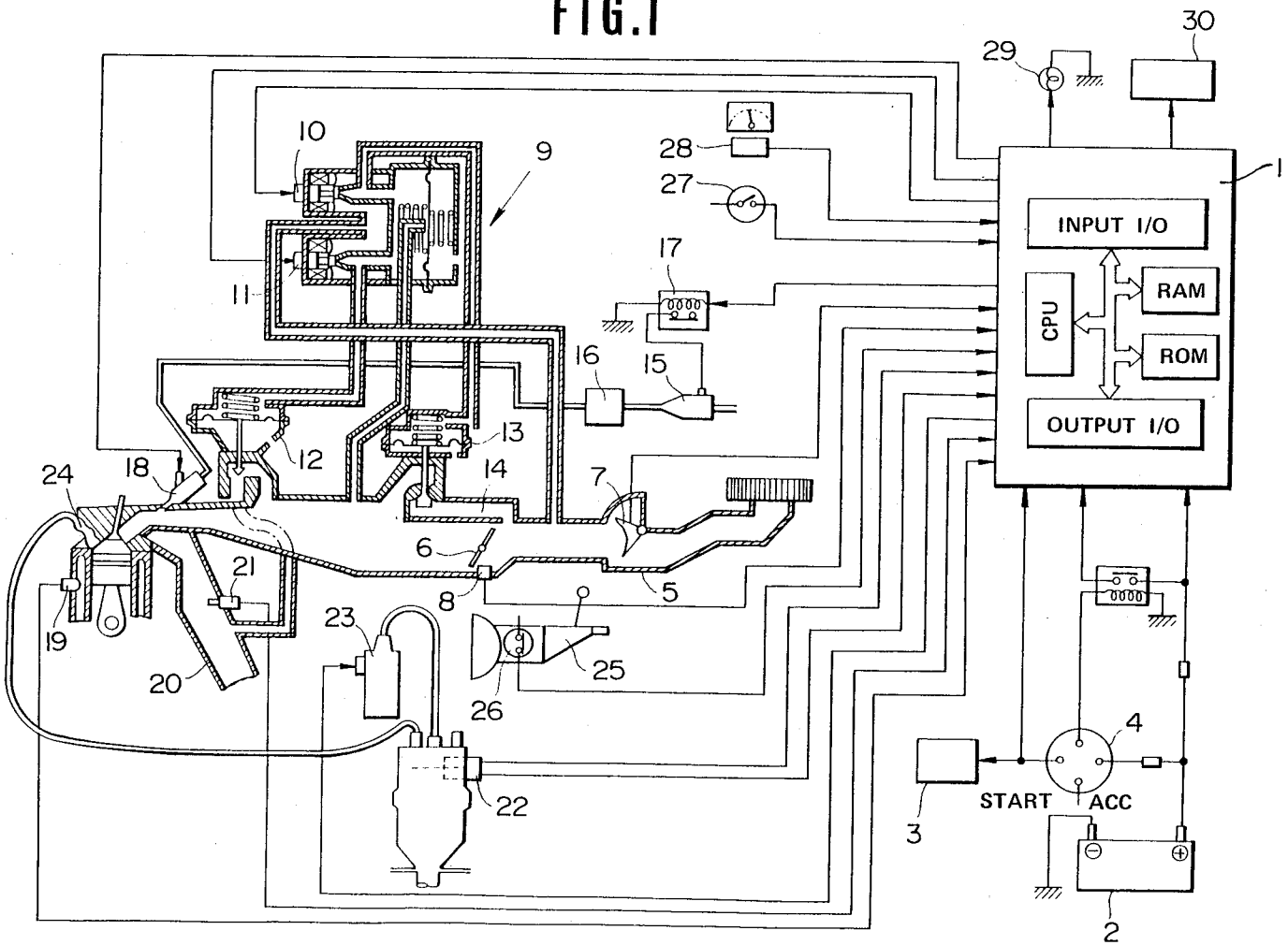
FIG. 1 shows the engine system discussed briefly in the opening paragraphs of the present disclosure.
Figure 2:
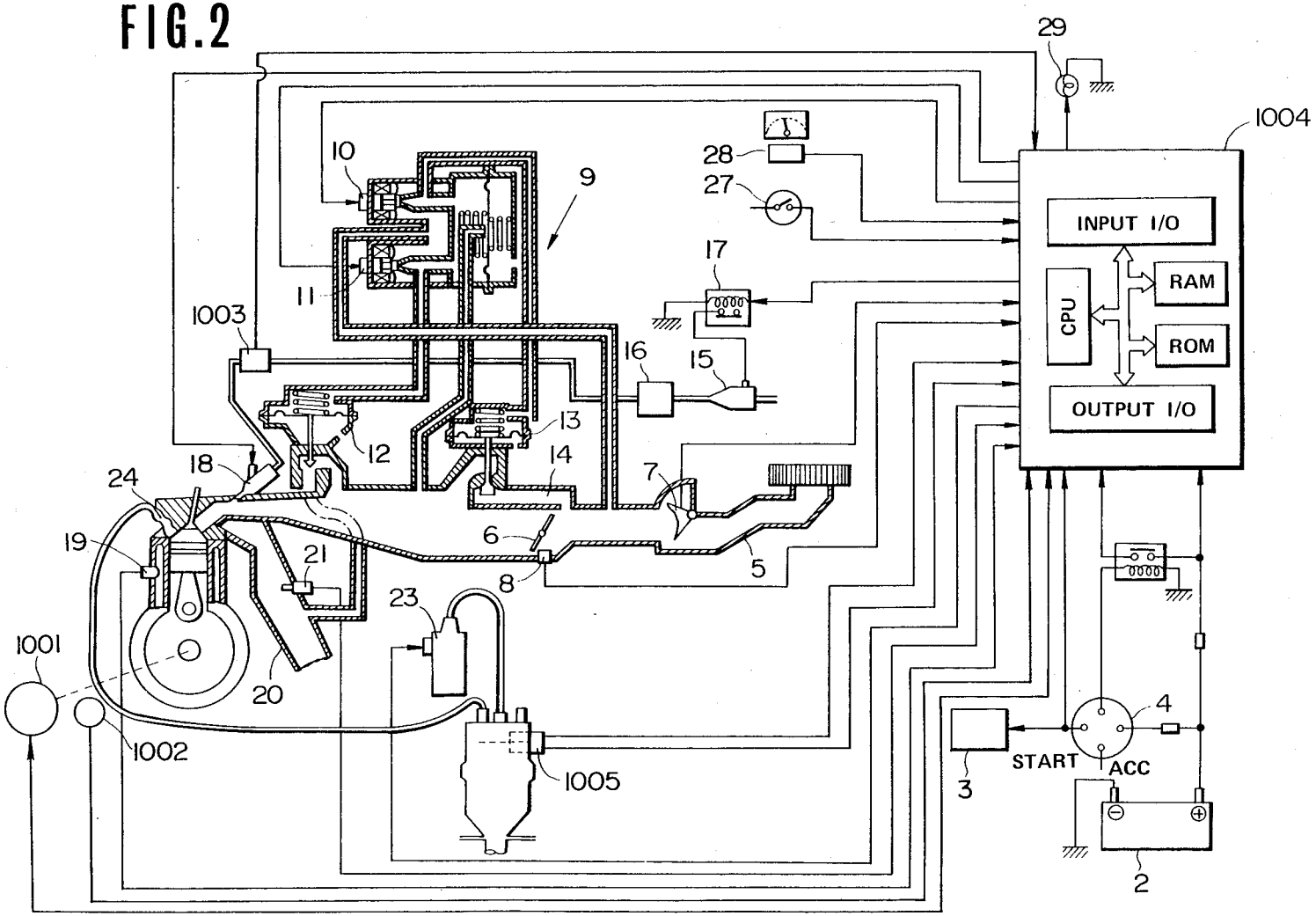
FIG. 2 shows an engine system embodying the present invention.

Turning now to FIG. 2 an engine system embodying the present invention is shown. The construction of this system is essentially the same as that disclosed in connection with the arrangement shown in FIG. 1 so that description will be made only to those elements which are different and/or of particular relevance. In this system, the transmission 25 is replaced with a continuously variable type transmission (CVT) 1001. An example of this type of CVT may be found in European Patent Application Publication No. 0 061 735 pulished on Oct. 6, 1982 (hereby incorporated by reference thereto) and corresponding Japanese Patent Application Provisional Publication No. Sho 57-161346 (published on Oct. 4, 1982). Further examples may be found in Japanese Patent Application Nos. Sho 56-137826 and Sho 56-137827.

A torque sensor 1002 is arranged between the engine and the transmission. This sensor is preferably of the type described in NIKKEI MECHANICAL pages 89 to 93 issue of May 24, 1982 which can detect torque magnetically and without mechanical contact with the drive shaft.

The fuel flow sensor 1003 utilized in this embodiment is of the turbine type which issues a signal in accordance with the fuel flow rate. Viz., senses the rotation of the turbine and outputs a signal the frequency of which is indicative of the fuel flow per unit time.

In this embodiment the microprocessor in the central control unit 1004 is programmed in a manner to periodically update a two dimensional fuel consumption ratio look-up table.

Figure 3:
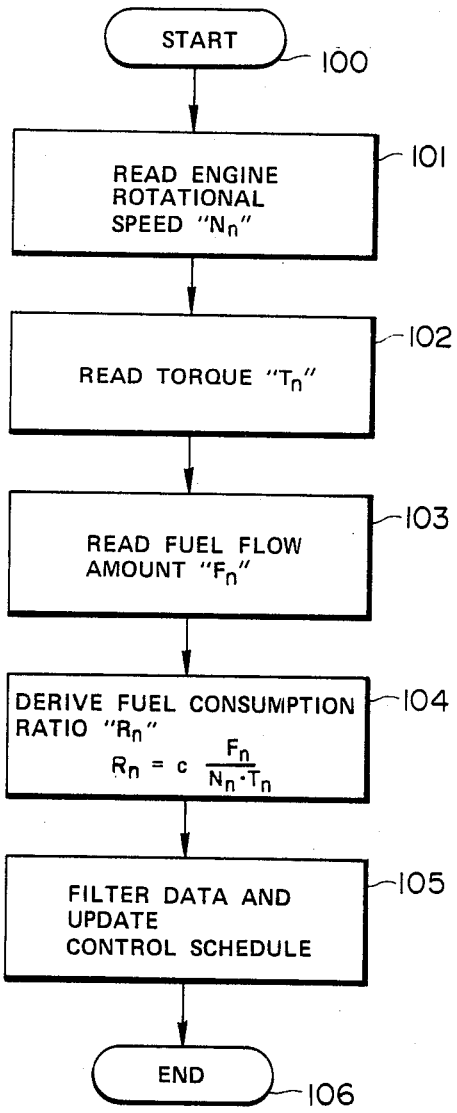
FIG. 3 is a flow chart showing the steps which characterize a vital part of the invention.

FIG. 3 shows in flow chart form an example of a program via which this table may be updated so as to accurately reflect the actual condition and characteristics of the engine.

As shown, following the START of the program (step 100) the momentary engine rotational speed "$N_n$", momentary engine torque "$T_n$" and momentary fuel flow "$F_n$" are read in steps 101, 102 and 103 respectively. In step 104 the momentary fuel consumption ratio "$R_n$" is derived using the equation:

$$R = cF/N.T \text{ (wherein c is a constant)} \quad (1)$$

At step 105 the data derived in step 104 is filtered to screen out any values which are nonindicative of the actual state of the engine.

For example, fuel flow rates recorded during acceleration, deceleration and the like which are apt to be highly atypical of the norm and are therefore ignored to avoid erroneous updating of the table. Subsequently the filtered data is used to replace the existing data in the table in question and the program terminates in step 106.

Methods of filtering may take the form of:

(a) averaging a predetermined plurality of sequential "R" values;

(b) maintaining a running average, for example taking the current reading of "R" adding same to the last 63 readings and averaging same;

(c) accepting "R" values which are within a predermined range of the last recorded value or averaged values; or (d) selecting readings which fall within a predetermined range of one and other and which continuously appear. As filtering is well known in the art of electronics and data processing as evidenced by pages 264–266 of the McGraw-Hill Encyclopedia of Electronics and Computers, no further explanation is deemed necessary.

It will be noted that due to the time required for the engine speed data to be compiled, the program of the FIG. 3 flow chart is of the interrupt type. Viz., the "N" data in this embodiment is collected by latching from a counter which counts over a predetermined time the number of unit angle signals produced by a crank angle sensor 1005. The "T" and "F" data is collected by analog-digital converting the output of the sensors 1002, 1003, respectively.

According to the present invention it is possible in the case it is considered necessary to retain data pertaining to atypical operations such as engine warm-up, acceleration, deceleration and the like, to provide separate look-up tables for same and to collect and update the data stored in these separately.

With any of the above mentioned tables it is possible that, during the course of normal operation of the vehicle, the full range of the engine speed and or CVT speed change range will not be encountered whereby a full direct revision of the tables in question is impossible. Accordingly, it is deemed highly advantageous to complete table revision by extrapolation. One method which may be used is updating all of the unmeasured values using the same previous/present difference ratio. Another is to update points displaced from the actual value measured by amounts which are inversely proportional to the displacement from the actually measured one. For example, if the ratio between the previous data and the new data is 1.0004 (0.4% increase) the next neighbouring point is incremented by ¼ of the actual difference (viz., increased by a factor of 1.001) while the subsequent point is updated by 1/16 of the actual different (a factor of 1.00025), etc.

Figure 4:
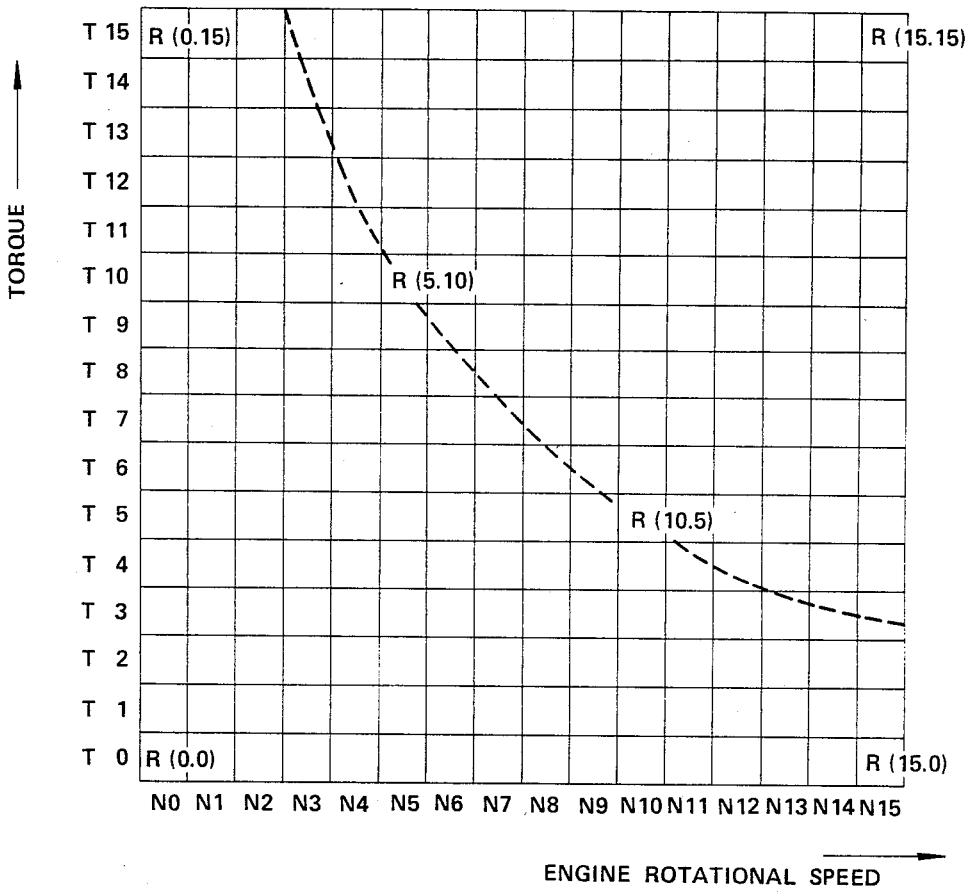
FIG. 4 is a graph illustrating a two dimensional table, the data retained in which is updated by the program disclosed in the FIG. 3 flow chart.

From the foregoing, it will be appreciated that the two dimensional table shown in FIG. 4, which may be stored in a suitable memory such as a non-volatile RAM, an EEPROM or the like, can be updated in manner to constantly reflect the actual condition of the engine.

In this embodiment, the look-up table shown in FIG. 4 is used in conjunction with a CVT control program and is used to look up the values of "N" and "T" which will, for a given amount of power output "P", induce the least amount of energy consumption. For example, given that the vehicle is operating in a manner wherein (merely by way of example) $N_n = 5$ and $T = 10$, then the power requirement "P" may be derived using:

$$P = N \times T \quad (2)$$

Accordingly, via table look-up it may be ascertained that for the same power requirement, the vehicle can be operated at $N = 10$, $T = 5$ with a notable decrease in fuel consumption.

Figure 5:
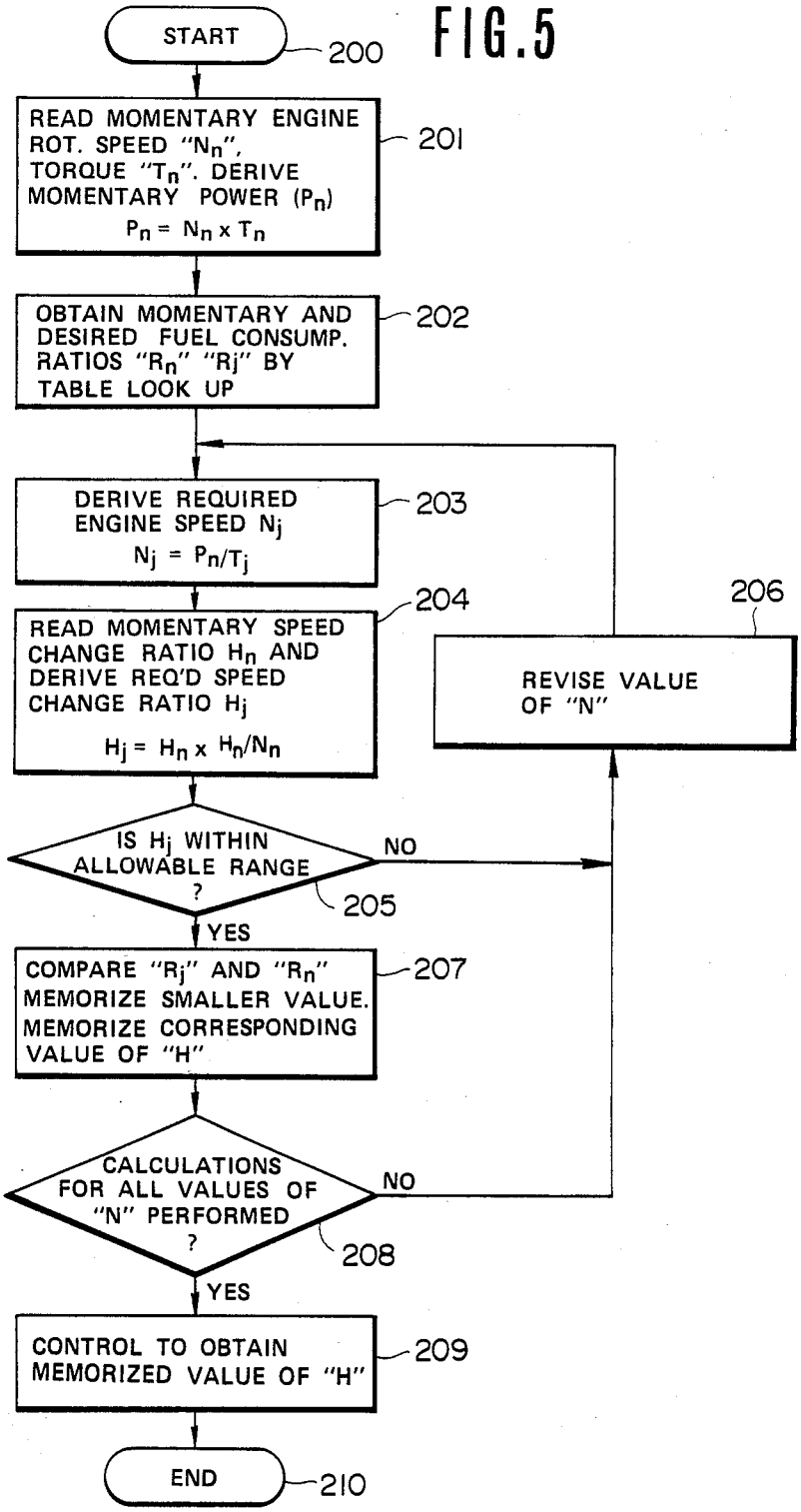
FIG. 5 is a flow chart showing the steps which characterize a control program used in the embodiment shown in FIG. 2.

FIG. 5 shows a flow chart which illustrates a program via which control of the CVT shown in FIG. 2 may be executed using the information available in the FIG. 4 look-up table.

As shown, following the START of the program (step 200) the momentary engine rotation speed $N_n$ and engine torque $T_n$ are read and the momentary power output $P_n$ of the engine derived. In step 202, the information derived in step 201 is utilized to enable the instanteous value of R (viz., $R_n$) to be derived and the desired value thereof which will provide the lowest fuel consumption rate (i.e. $R_j$) to be looked up and held ready for further processing. In step 203 the required engine speed $N_j$ is derived and used in step 204 to derive the required change in speed change ratio $H_j$ which will induce the desired values of N and T to be implemented. At step 205 the program enquires as to whether the derived value of $H_j$ falls with an allowable range, Viz., within the physical capacity of the CVT. If the answer to this enquiry is NO the program in step 206 revises the value of N and subsequently returns to step 203 as shown. In the event the answer to the question posed in step 205 is YES, the program proceeds to step 207 wherein $R_n$ and $R_j$ are compared and the smaller of the two stored for control purposes. The value of H corresponding to the stored R value is also stored. In step 208 an enquiry as to whether calculations for all of the values of "N" have been performed. If not, the program recycles as shown. If the answer is YES the the program proceeds to step 209 wherein the stored values of "R" and "H" are used to execute the control of the transmission.

Although the embodiment of FIG. 2 has been disclosed as using particular types of flow meter and torque sensor, it will be appreciated that it is possible to use in place of the fuel flow meter 1003 output, data such as fuel injection pulse width and the pressure with which fuel is injected to derive the fuel flow rate. Further, the torque of the engine may be derived indirectly by measuring induction vacuum, throttle opening degree, air flow rate or the like.

It will be further appreciated that the present invention is not limited to using look-up tables wherein torque is plotted against engine speed. For example, vehicle speed may be plotted against the transmission speed change ratio. This would enable direct look-up of the required speed change ratio $H_j$ for any given vehicle speed. A yet further alternative may take the form of ignition timing plotted against EGR rate. Of course fuel consumption per unit rotation may be used in place unit consumption per unit time.

The present invention may also be applied to vehicles using a stepped transmission. In the case of automatic plural forward speed transmissions, the appropriate shift timing may decided while in the case of a manual transmission a visual display indicating the most appropriate gear can be utilized.

What is claimed is:

1. In a control method for an apparatus wherein the fuel consumption characteristics thereof change with use, the steps of:

(a) continuously sensing at least two parameters of said apparatus, one of said parameters being related to fuel consumption;

(b) maintaining a control schedule related to said sensed parameters and periodically updating said control schedule in response to the values of the parameters sensed in step (a) during both transient and non-transient modes of operation; and (c) controlling said apparatus in accordance with said control schedule so as to minimize the fuel consumption of same.

2. A method as claimed in claim 1, wherein said apparatus comprises an automotive internal combustion engine having a speed change transmission associated therewith and wherein said step (a) comprises:

sensing the engine rotational speed;

sensing the torque outputted by said engine; and sensing the amount of fuel supplied to said engine.

3. A method as claimed in claim 1, further comprising the step of filtering the sensed values of said at least two parameters so as to exclude values which are non indicative of the actual state of the apparatus.

4. A method as claimed in claim 3 wherein said step of filtering comprises:

averaging a predetermined number of sensed parameter values.

5. A method as claimed in claim 3 wherein said step of filtering comprises:

maintaining a running average of a predetermined number of sensed parameter values.

6. A method as claimed in claim 3, wherein said step of filtering comprises:

accepting only sensed parameter values which are within a predetermined range of previous ones.

7. A method as claimed in claim 3 wherein said step of filtering comprises:

selecting sensed parameter values which are within a predetermined range of one and other and which frequently appear.

8. A method as claimed in claim 3, further comprising the steps of:

using a microprocessor to execute said steps of sensing, updating and controlling; and using a memory of said microprocessor to store said schedule in the form of a look-up table.

9. A method as claimed in claim 8, wherein said step of updating includes updating the data included in said look-up table by extrapolation in the event that the data sensed does not extend over the full range of the data present in said table.

10. In a vehicle including an internal combustion engine and a continuously variable transmission operatively associated therewith, a control method comprising the steps of:

(a) continuously sensing the values of a first group of operational parameters of said engine;

(b) periodically updating a control schedule in response to said sensed values during both transient and non-transient modes of engine operation;

(c) determining, using said control schedule, the values of a second group of operational parameters which, if achieved, cause said engine and said transmission to assume states wherein the least amount of fuel will be consumed to produce a given amount of power; and inducing said engine and said transmission to assume said states wherein said determined values of said second group of parameters are achieved and the fuel consumption of said engine is minimized.

11. A method as claimed in claim 10, further comprising the steps of:

using a microprocessor to execute said steps of sensing, updating and determining; and using a memory of said microprocessor to store said control schedule in the form of a look-up table;

filtering the data obtained in said step of sensing to exclude values which do not reflect the actual condition of said engine; and using said filtered data to update said control schedule.

12. A method as claimed in claim 11, further comprising the steps of:

separately memorizing data derived during preselected modes of vehicular operation; and separately updating said separately memorized data.

13. In an apparatus wherein fuel consumption characteristics thereof change with use, means for continuously sensing at least two parameters of said apparatus, one of said parameters being related to fuel consumption;

means for maintaining a control schedule related to said sensed parameters and periodically updating said control schedule in response to the values of the parameters sensed in step (a) under both transient and non-transient conditions; and means for controlling said apparatus in accordance with said control schedule so as to minimize the fuel consumption of same.

14. An apparatus as claimed in claim 13, wherein said apparatus comprises an automotive internal combustion engine having a speed change transmission associated therewith and wherein said continuously sensing means includes:

a device for sensing the engine rotational speed;

a device for sensing the torque outputted by said engine; and a device for sensing the amount of fuel supplied to said engine.

15. An apparatus as claimed in claim 13, further comprising means for filtering the sensed values of said at least two parameters so as to exclude values which are non indicative of the actual state of the apparatus.

16. An apparatus as claimed in claim 15 wherein said filtering means includes:

an arrangement for averaging a predetermined number of sensed parameter values.

17. An apparatus as claimed in claim 15 wherein said filtering means includes:

an arrangement for maintaining a running average of a predetermined number of sensed parameter values.

18. An apparatus as claimed in claim 15, wherein said filtering means includes:

an arrangement for accepting only sensed parameter values which are within a predetermined range of previous ones.

19. An apparatus as claimed in claim 15 wherein said filtering means includes:

an arrangement for selecting sensed parameter values which are within a predetermined range of one and other and which frequently appear.

20. In a vehicle including an internal combustion engine and a continuously variable transmission operatively associated therewith, means for continuously sensing the values of a first group of operational parameters of said engine;

means for periodically updating a control schedule in response to said sensed values under both transient and non-transient conditions;

means for determining, using said control schedule, the values of a second group of operational parameters which, if achieved, cause said engine and said transmission to assume states wherein the least amount of fuel will be consumed to produce a given amount of power; and means for inducing said engine and said transmission to assume said states wherein said determined values of said second group of parameters are achieved and the fuel consumption of said engine is minimized.

21. A vehicle as claimed in claim 20, further comprising:

means for filtering the data obtained by said sensing means so as to exclude values which do not reflect the actual condition of said engine; and means for using said filtered data to update said control schedule.

22. A vehicle as claimed in claim 21, further comprising:

means for separately memorizing data derived during preselected modes of vehicular operation; and means for separately updating said separately memorized data.

* * * * *